US006155167A

United States Patent [19]

Meyer

[11] Patent Number: 6,155,167

[45] Date of Patent: Dec. 5, 2000

[54] PRINTING DOCTOR WITH A COATING OF HARD MATERIAL AND METHOD FOR PRODUCING SAME

[76] Inventor: Rolf Meyer, Heinrich-Hertz-Strasse 17, 22941 Bargteheide, Germany

[21] Appl. No.: 09/234,527

[22] Filed: Jan. 21, 1999

[51] Int. Cl.[7] ..... B41F 9/10

[52] U.S. Cl. ..... 101/157; 101/169

[58] Field of Search ..... 101/169, 157; 118/118, 119, 123

[56] References Cited

U.S. PATENT DOCUMENTS

| | | | |
|---|---|---|---|
| 4,485,738 | 12/1984 | Gertsch et al. | 101/365 |
| 4,735,144 | 4/1988 | Jenkins | 101/464 |
| 4,895,071 | 1/1990 | Benton | 101/169 |
| 5,238,495 | 8/1993 | Madrzak | 118/261 |
| 5,432,539 | 7/1995 | Anderson | 347/33 |
| 5,536,312 | 7/1996 | Madrzak et al. | 118/118 |
| 5,638,751 | 6/1997 | Daetwyler et al. | 101/169 |
| 5,709,751 | 1/1998 | Van Der Meulen | 118/413 |
| 5,713,276 | 2/1998 | Teoh et al. | 101/123 |

FOREIGN PATENT DOCUMENTS

| | | |
|---|---|---|
| 728579 | 8/1996 | European Pat. Off. . |
| 4024514 | 2/1992 | Germany . |
| 499463 | 1/1939 | United Kingdom . |

OTHER PUBLICATIONS

Patent Abstracts of Japan, vol. 96, No. 12, Dec. 26, 1996 & JP 08 197711 A (TOPPAN Printing Co. LTD.) Aug. 6, 1996.

Patent Abstracts of Japan, vol. 17, No. 106 (M–1375), Mar. 4, 1997 & JP 04 296556 A (TOPPAN Printing Co. LTD.) Oct. 20, 1992.

*Primary Examiner*—Daniel J. Colilla
*Attorney, Agent, or Firm*—Alix, Yale & Ristas, LLP

[57] ABSTRACT

Printing doctor having a doctor body and a coating of hard material which covers at least that end face of the doctor body which is intended to bear against a rotating cylinder. In order to provide the coating of hard material with a greater stability, before the coating of hard material is applied, the surface of the doctor body is provided, at least within the end face, with a multiplicity of recesses, the maximum diameters of which are in each case considerably smaller than the width of the end face. These maximum diameters expediently lie below 1/50 of the width of the end face, or between 0.1 and 10 $\mu$m. The recesses are expediently produced by an ECM process.

10 Claims, 1 Drawing Sheet

PRINTING DOCTOR WITH A COATING OF HARD MATERIAL AND METHOD FOR PRODUCING SAME

BACKGROUND OF THE INVENTION

The purpose of printing doctors is to strip the excess ink off a rotating form cylinder. They normally comprise a thin strip of steel sheet which is clamped along one edge in a holder while its free edge bears resiliently against the cylinder. A very narrow end face, which bears against the cylinder surface, of the doctor plate is provided at the free edge, the width of which end face (measured transversely to its longitudinal extent) lies in the order of magnitude of 0.1 mm or less. EP-A-709 183 shows a typical example. During use, the end face of the doctor becomes worn, a fact which limits the service life of the doctor. To extend the service life, it is known to coat the end face of the doctor body, which is formed by the strip of steel sheet, with a hard material which is applied by physical vapour deposition (PVD) or plasma-activated chemical vapour deposition (PA-CVD). Examples are to be found in DE-A 40 24 514 and in Japan Patent Abstract 8197711. In the PVD process, atoms or particles are removed from a target by sputtering or using the arc process and are conveyed in the plasma onto the surface which is to be treated. In the PA-CVD process, the layer deposition takes place by means of the plasma activation of a hydrocarbon-containing gas. The hard material is preferably DLC (diamond-like carbon), a layer of carbon or a carbon-rich layer which is in part essentially characterized by diamond crystal structures and has corresponding resistance to abrasion and good sliding properties. However, it is also possible to use other hard material or mixtures of DLC with other substances, in particular metal. In this way, that surface of the doctor which is subjected to load caused by friction against the form cylinder is provided with an increased wear resistance and good sliding properties. Examples of suitable hard coatings are disclosed by GB-A 2 128 551, WO 86/07309, DE-C 37 14 327, EP-B 087 836, DE-A 32 46 361. It is also known from Japan Patent Abstract 4296556 to apply ink-repelling materials to doctor surfaces using the CVD process.

The layer of hard material is brittle. There is therefore a risk of impacts or temperature changes causing cracks which impair the cohesion within the layer of hard material or its adhesion to the doctor body. Then, under frictional loading, parts of the coating may become detached or splinter off. This not only impairs the service life of the doctor but also that of the surface of the impression cylinder, owing to the fact that the sharp edges of the coating which remain at the site of the defects have an abrasive action and may cause strips on the printed product. Therefore, the abovementioned hard coatings of the end face of doctors have hitherto not been able to gain widespread acceptance in practice.

SUMMARY OF THE INVENTION

The invention combats this risk by means of the features specified in the claims.

Before the coating of hard material is applied, the surface of the end face of the doctor body is provided with a multiplicity of very small recesses fissures or craters, the maximum entry diameter or span of which is in each case considerably smaller than the width of the end face, preferably less than 1/50 of this width. The recesses are accurately reproduced in the hard coating. In the surface of this coating, the maximum diameters of the recesses are expediently less than 10 $\mu$m, more preferably less than 2 $\mu$m and particularly preferably less than 0.5 $\mu$m, but preferably above 0.1 $\mu$m. The centre-to-centre distances of adjacent recesses in the coating surface are expediently no greater than 10 $\mu$m. The maximum diameter is to be understood as the largest dimension of a single recess at its open edge. If possible, the maximum diameters of all the recesses should lie below the thresholds indicated. However, if the maximum diameters of a few recesses exceed a threshold, this is not important if it does not affect, or does not significantly affect, the desired result.

Between the recesses, it is preferable for the originally planar surface of the end face of the doctor body to be essentially retained. As a result, a planar surface area, which expediently covers less than 20%, more preferably less than 10%, of the total surface area of the end face, remains even in the surface of the coating between adjacent recesses. However, good results can also be obtained if the electrochemical treatment is continued until there are no longer any, or any significant, planar surface areas between adjacent recesses. Although in this case the end face, when viewed under the microscope, is very undulating and fissured, the fact that it is composed of very many elements, the dimensions of which are small by comparison with the total width of the end face, means that they combine over the width of the end face to form a uniform, if apparently rough, surface structure.

The recesses can be formed by an electrochemical machining (ECM) process, as is described in EP-A 728 579 for the end face of doctors. This document recommends the ECM process for treating the end face of a steel doctor in order to avoid the formation of burrs on the rear edge of the end face, as seen in the direction of movement of the cylinder. The formation of these burrs is a result of the fact that, during the tribological contact between the doctor end face and the surface of the cylinder, atoms or particles are torn out of the surface of the doctor, are conveyed onward by the relative movement and are deposited again at a different location—ultimately at the abovementioned edge or at the burrs which are formed on this edge. This phenomenon does not arise if the end face has a hard coating of the abovementioned type, because there are no particles torn out of the hard coating, and consequently such particles cannot be deposited again in undesirable positions. The effect in the combination according to the invention of the hard coating with the doctor surface form which is characterized by a multiplicity of recesses is rather different. Owing to the multiplicity of recesses in the surface of the doctor body, the layer of hard material is better able to attach itself to this surface. Furthermore, the coating does not form a planar plate, but rather has many curves in the region of the recesses. These multiple curves allow it to have a more flexible performance with respect to forces acting in the direction of the extent of the end face. It is therefore more resistant to thermal stresses and is also able to withstand impact to stresses in a more elastic manner. The probability of cracks being formed under thermal or impact stresses is lower. If cracks should form, the risk of parts of the coating breaking off is also reduced. Therefore, in practice, the doctors according to the invention prove to be considerably stronger than the known doctors. Since the effect of the ECM process which precedes the coating is completely different from that of the known application of the ECM process, the combined effect of the ECM process and of the coating of hard material was also not obvious.

A further advantage of the nonplanar form of the surface of the end face lies in the fact that a hydrodynamic lubrication action is established. The planar part, lying between the recesses, of the doctor end face is essentially responsible for transmission of force to the opposite face of the cylinder. Since this planar face is divided into a large number of surface elements, each next to recesses, it is unlikely that there will be any dry friction between these surface elements and the opposite face, since the recesses act as a liquid reservoir from which a hydrodynamically acting film of liquid for the adjacent surface elements is continually fed.

Advantageously, the hard material is applied in a smooth layer. This is achieved by sputtering the target, so that the coating material is taken from the target with the fineness of single atoms and passes onto the surface to be treated in this form.

A less smooth, microscopically undulating coating of matt appearance is obtained using the so-called arc process or a process of similar nature, in which the coating particles leave the target on their way towards the surface to be treated not as single atoms, but rather in the form of larger agglomerates. Although the properties of the smooth layer are often better, in some cases the undulating or matt layer may be preferable, since it has particularly little tendency to form spalls and, moreover, owing to its microscopic undulations, promotes a hydrodynamic lubrication effect.

If the doctor body consists of steel which has been hardened and tempered at below 300° C., the PVD or CVD process is expediently carried out in such a manner that the temperature of the doctor body remains at below approximately 250° C. in the process. This ensures that the quality of the doctor body is not impaired by the thermal stressing during the coating operation.

Advantageously, it is not only the end face of the doctor which is coated with the hard material, but also the edges of the end face and at least that part of the pair of surfaces delimiting the end face which adjoins the edges.

Since the locally different etching action of the electrochemical machining process is dependent on the grain structure of the doctor body, it is expedient to select the alloy and the microstructural condition of the doctor body in such a manner that the grain structure corresponds to the desired recess dimensions of the surface. The centre-to-centre distances of adjacent microstructural grains of the doctor body should approximate to the desired centre-to-centre distances of adjacent recesses in the surface. Advantageously, they are between 0.05 and 1 $\mu$m.

BRIEF DESCRIPTION OF THE DRAWING

The single FIGURE of the drawing shows a partial sectional view of the end face portion of the printing doctor of the present invention.

DESCRIPTION OF A PREFERRED EMBODIMENT

Figure 1:
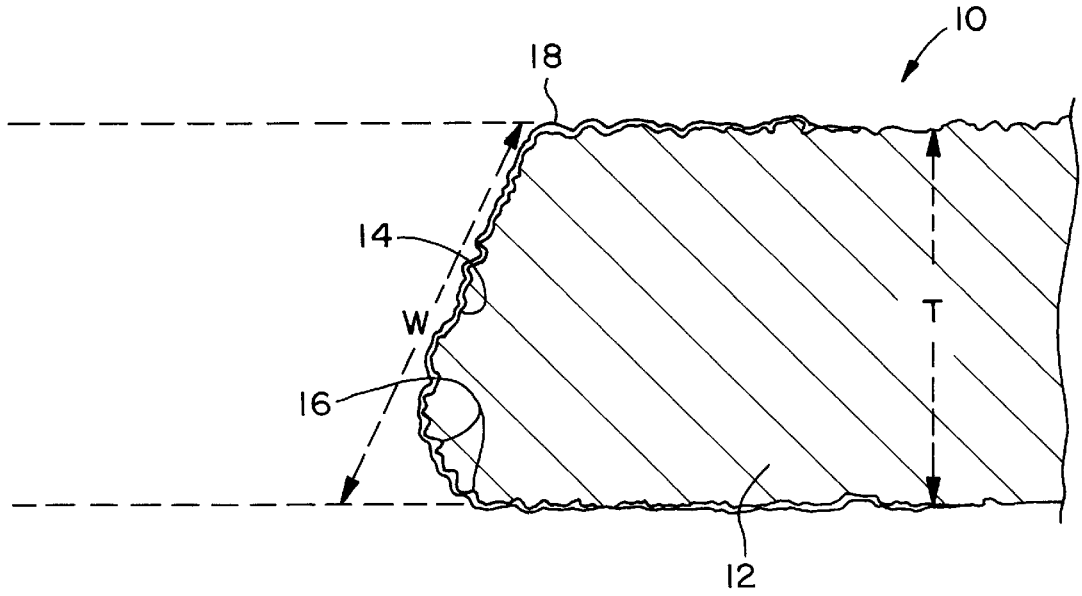

Details of the invention will emerge from the following explanation of examples.

A steel doctor 10 having the dimensions 0.15×40 mm is ground at one edge, as shown in EP-A 728 579, so as to form a lamella 12 which is 1 mm wide and 0.06 mm thick T (measured as indicated on FIG. 1). The end face 14 of the lamella 12 is ground at an angle of 60°, so that its width W (measured as indicated on FIG. 1) is approximately 0.07 mm. The end face, as well as the lamella side faces which adjoin it on both sides, are subjected to an electrochemical machining process in accordance with EP-A 728 579, so as to form a multiplicity of small recesses 16 which cover approximately 90% of the end face.

The steel doctor which has been treated in this way is then fed continuously through a PVD chamber.

In a first example, the following process parameters are generated in this chamber; at a discharge pressure of approx. 500 mPa, chromium is atomized in an atmosphere of argon and a hydrocarbon gas, such as for example, $C_2H_6$, $C_2H_2$ or $C_2H_4$. The chromium target is atomized using a DC feed of approx. 1500 W. This low power level is necessary to keep the temperature of the parts which are to be coated at less than 200° C. In order to achieve smooth and hard layers, a DC voltage or high-frequency voltage (13.56 MHz) of approx. (−100 V) is additionally applied to the parts which are to be coated. This difference in potential between the substrate holder and the surrounding walls leads to the substrates or the chromium atoms being bombarded with argon and hydrocarbon ions, so that the layer material is compacted. As a result, a coating layer 18, the thickness of which is between 1 and 10 $\mu$m, preferably between 2 and 4 $\mu$m, and which viewed under the microscope smoothly follows the surface form of the substrate, is produced on the facet and, in a width of the order of magnitude of 1 mm, on the adjacent side faces. When pressed gently against the forme cylinder, in the same way as it is customarily used, the result is excellent printing results and an unusually long service life.

In a second example for plasma-activated CVD, the following process parameters are generated in this chamber: a DC or HF power of approx. 1000 W and a corresponding voltage of approx. 110 V are applied to the substrate holder. At a discharge pressure of approx. 400 mPa and an argon/hydrocarbon ($C_2H_2$) gas ratio of approximately 1, a plasma arcs, leading to the deposition of hard DLC layers. The targets themselves are disconnected in this process, so that there is a pure plasma-activated chemical vapour deposition. In order to activate the plasma, there may also be a low level of power feed (approx. 300 W) across the chromium targets.

In addition to DLC, other suitable hard materials are chromium nitride, titanium nitride, titanium carbonitride, titanium aluminium nitride, chromium carbide, titanium hafnium nitride, titanium boride or titanium boron carbide and the like, as well as mixtures of such materials with one another or with other substances, metals. The layer should be selected in such a manner that, in conjunction with the underlying surface or a parting layer which may be provided between the underlying surface and the coating, it is not susceptible to corrosion.

What is claimed is:

1. A printing doctor having a doctor body with a free end for engagement with a rotating rotogravure cylinder, said free end having an end face and doctor body surfaces immediately adjacent the end face, the free end having coating means for resisting abrasion which covers at least that end face of the doctor body which is intended to bear against the rotating cylinder, characterized in that the end face has multiplicity of recesses, and the maximum span of said recesses is no greater than 1/50 of the width of the end face.

2. Printing doctor according to claim 1, characterized in that the recesses are reproduced in the surface of the coating and that the maximum span of the recesses in the surface of the coating is less than 10 $\mu$m.

3. Printing doctor according to claim 2, characterized in that the surface of the coating is essentially planar between the recesses.

4. Printing doctor according to claim 3, characterized in that the essentially planar area between the recesses covers no more than 20% of the total surface area of the end face.

5. Printing doctor according to claim 1, characterized in that the recesses are reproduced in the surface of the coating and that the maximum span of the recesses in the surface of the coating is greater than 0.1 $\mu$m.

6. Printing doctor according to claim 1, characterized in that the centre-to-centre distances of adjacent recesses are on average no greater than 10 $\mu$m.

7. Printing doctor according to claim 1, characterized in that said end face and adjacent body surfaces form edges and the coating also covers the edges and the surfaces delimiting the end face which adjoins the edges.

8. Printing doctor according to claim 1, characterized in that the doctor body is formed by a steel or an alloy with a fine grain structure.

9. Printing doctor according to claim 1, characterized in that the abrasion resistant material is formed by carbon characterized in part by a diamond crystal structure.

10. A printing doctor comprising:

a doctor body with a free end for engagement with a rotating rotogravure cylinder, said free end having an end face and doctor body surfaces immediately adjacent the end face, said end face and doctor body surfaces having a multiplicity of recesses, said free end having a coating of abrasion resistant material having a surface which reproduces said recesses, wherein said end face and doctor body surfaces are essentially planar between said recesses and the essentially planar area of said end face covers no more than 20% of the total surface area of the end face.

* * * * *